United States Patent [19]

Cook

[11] 4,042,981

[45] Aug. 23, 1977

[54] TOILET WASTE HOLDING APPARATUS

[75] Inventor: John Walter Cook, Garner, N.C.

[73] Assignee: North American Philips Corporation, New York, N.Y.

[21] Appl. No.: 617,988

[22] Filed: Sept. 29, 1975

[51] Int. Cl.[2] ..... E03D 9/04

[52] U.S. Cl. ..... 4/10; 4/114; 4/209 R; 210/152

[58] Field of Search ..... 4/8, 10–12, 4/72, 78, 80, 83, 89, 96, 111, 114–116, 126, 136, 209, 210, 216, 219, 220; 98/78; 210/152

[56] References Cited

U.S. PATENT DOCUMENTS

| | | | |
|---|---|---|---|
| 2,094,537 | 9/1937 | Hinds | 4/126 |
| 2,514,230 | 7/1950 | Feazel | 4/114 |
| 2,630,577 | 3/1953 | Morris | 4/8 |
| 3,570,016 | 3/1971 | Ellis et al. | 4/8 |
| 3,579,651 | 5/1971 | Russo | 4/10 X |
| 3,733,619 | 5/1973 | Smith | 4/72 |
| 3,912,598 | 10/1975 | Dick | 4/10 X |
| 3,921,228 | 11/1975 | Sundberg | 4/111 X |

*Primary Examiner*—Richard E. Aegerter
*Assistant Examiner*—Stuart S. Levy
*Attorney, Agent, or Firm*—Frank R. Trifari; David R. Treacy

[57] ABSTRACT

A toilet waste holding apparatus for a vehicle has a vent which sucks away tank gasses and odors, without permitting sewage overflow to enter the vent. An insert allows entrance of clean air to the tank and access to the interior for cleaning.

5 Claims, 2 Drawing Figures

Fig. 1.
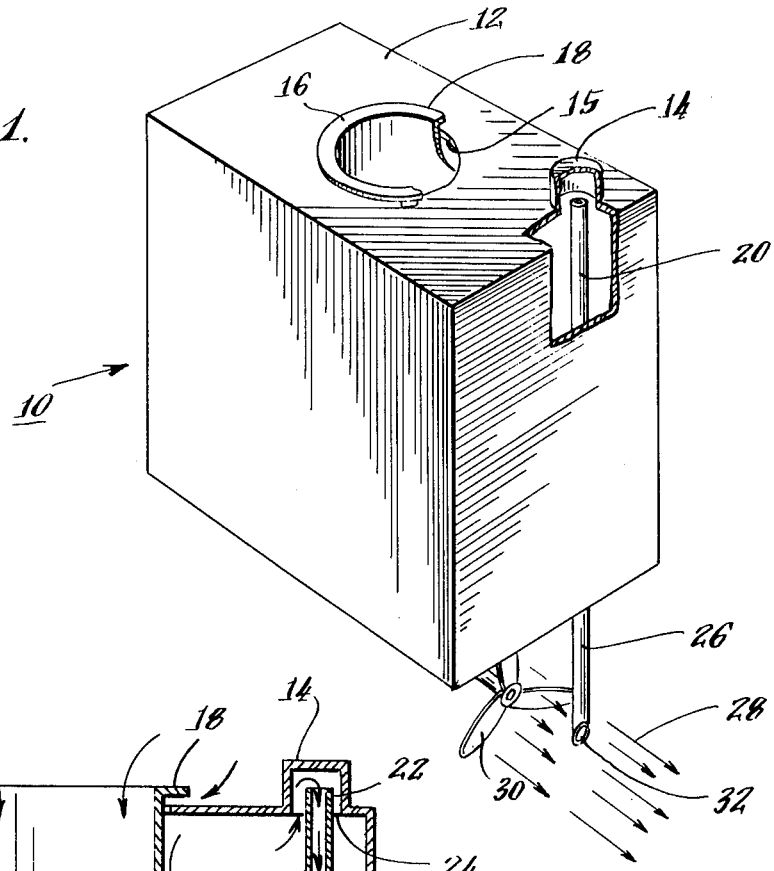
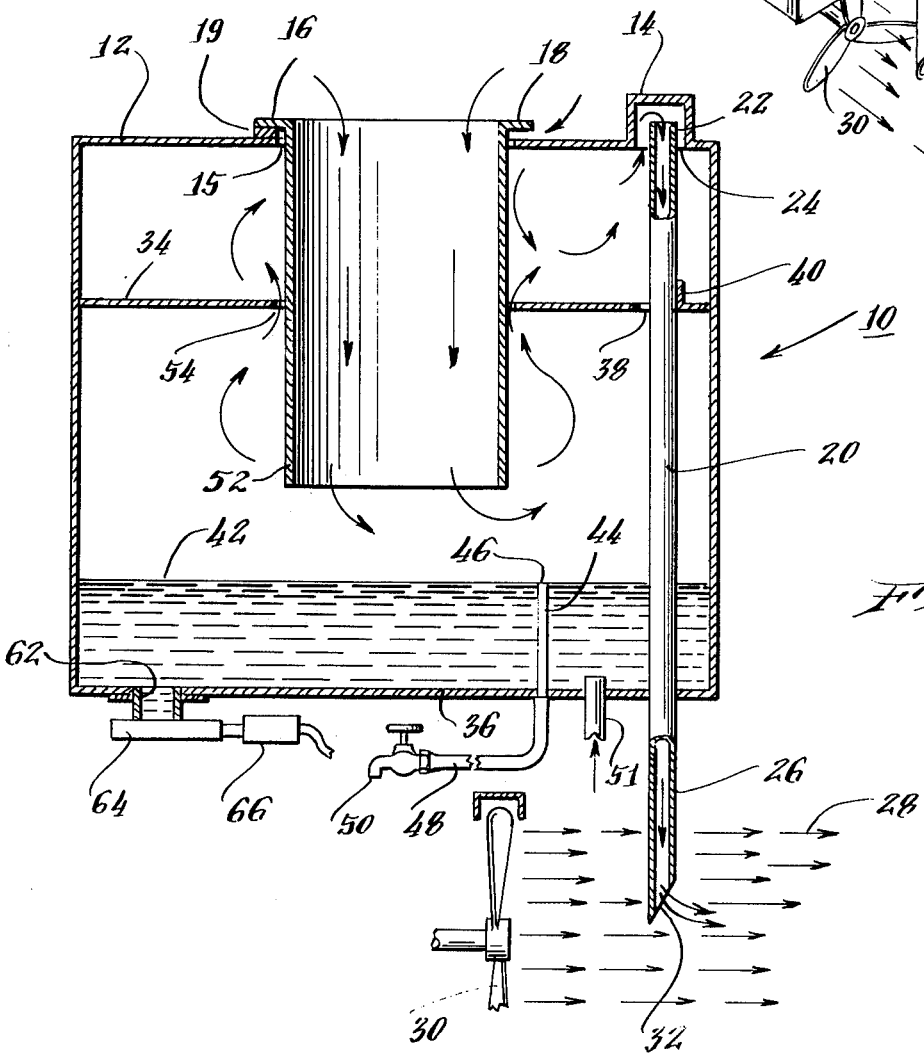
Fig. 2.

TOILET WASTE HOLDING APPARATUS

BACKGROUND OF THE INVENTION

1. Field of the Invention

This invention relates to toilet waste tanks for vehicles, and in particular to systems in which human waste materials are chemically treated and stored in a relatively small tank which will periodically be emptied into a sewage system. In accordance with the modern trend to protection of the environment, such systems are especially designed to prevent the escape of untreated liquid or solid wastes, and also to limit the escape of noxious odors. Effective, simple servicing procedures are necessary so that rest rooms stay sanitary and clean-smelling.

2. Description of the Prior Art

Prior art sanitary waste tanks for vehicles fall into a number of categories, ranging from the very simple to the fairly complicated. U.S. Pat. No. 2,094,537 shows an early chemical toilet apparatus in which provision is made to prevent the escape of contents during motion of the vehicle or when the toilet is not in use. When the toilet seat is lowered, a large valve directly below the seat completely closes off the main opening into the storage tank, so that neither liquid nor gasses can escape to the interior of the vehicle. A simple ventilation pipe connects from the top surface of the tank, typically up through the roof of the vehicle. This type of installation suffers the disadvantage that unpleasant odors may rise into the vehicle when the seat is opened, because there is no provision to ensure that in the open seat condition air flow will be down through the toilet opening into the interior of the tank and up the vent pipe.

U.S. Pat. No. 3,583,675 is concerned with a recirculating toilet system for a vehicle, in which a chemically treated liquid is pumped from the bottom of a tank to flow along exposed surfaces of a toilet bowl and to remove contents clinging to those surfaces down to the tank. If such a recirculating toilet is used so often that the liquid becomes heavily contaminated, then each time the tank is flushed this contaminated water flows along an exposed surface from which odors can be released to the interior of the vehicle. Toilets of this general type are not equipped with a positive ventilation system that removes odors rising from the liquid surface by way of a vent pipe such that they will be released in a place which is not offensive to the vehicle occupants. Further, known designs of recirculating toilets of this general type render thorough interior cleaning very difficult, because there is no access to the interior of the holding tank except through the relatively small opening through which wastes pass from the toilet bowl, or by disassembly and removal of the entire pump unit. Further, when these units are serviced by relatively unskilled personnel, problems sometimes arise because the wrong amount of fresh water is added to the tank. In particular, if too much fresh water is added this time, the effectiveness of the chemicals is reduced, and the usage capacity of the toilet before it becomes overfull is also reduced.

SUMMARY OF THE INVENTION

An object of the invention is to provide a toilet waste holding tank from which offensive fumes will be removed at all times that the vehicle is actually in service, including times when the vehicle is standing still, such as when it is stopped in traffic.

A further object of the invention is to provide a waste tank venting system in which overflowing of liquid into the vent and distribution of offensive material by a forced ventilating system is prevented.

Yet another object of the invention is to provide a toilet waste holding tank from whose interior escape of liquid is prevented in normal operation, without hindering ready access to the entire interior of the tank for cleaning.

According to the invention, a toilet waste holding apparatus for a vehicle has a tank to which is connected a vent pipe, one end of the vent pipe being exposed in a moving stream of air such that is developed to move air and gasses in the vent pipe out into the moving stream of air, the other end of the vent pipe being connected to the top of the tank such that any overflow of stored waste liquid in the tank will not enter the vent pipe.

According to another feature of the invention, ventilating air enters the waste holding tank through a removable insert which also functions as the opening through which human waste falls into the tank, thereby preventing the escape of offensive odors into the vehicle when the tank is being used.

BRIEF DESCRIPTION OF THE DRAWING

A preferred embodiment of the invention will now be discussed in detail with respect to the drawing, in which:

FIG. 1 is a perspective view of a waste holding apparatus according to the invention, and FIG. 2 is a side view, partly in cross-section, of the apparatus of FIG. 1.

DESCRIPTION OF THE PREFERRED EMBODIMENT

As shown in FIG. 1, a waste tank 10, generally rectangular in shape, has a top surface 12 from which a vent cap 14 protrudes a small distance. The top surfaces has an opening 15 slightly larger than, but generally of the same shape as, the opening in a toilet seat (not shown) of any well-known shape and size, below which the waste holding tank will be installed. A removable insert 16 having a flange 18 around its upper end is placed in the opening 15 so as to extend down into the tank, the flange 18 overlapping the top surface 12, and is held in place simply by the force of gravity. The flange 18 is held above the flat surface of the top 12 by three spacers 19, to permit air flow under the flange.

A vent pipe 20 passes up through the tank so that its upper end 22 projects through a vent opening 24 in the top surface 12 into the space inside the vent cap 14, so that gasses from the waste liquid can escape into the vent cap and down through the vent pipe. A lower end 26 of the vent pipe extends below the tank 10 into a stream 28 of moving air coming from the air conditioning condenser fan 30 of the vehicle. An oblique cut 32 in the lower end 26 of the vent pipe causes the moving stream of air to develop suction at the lower end of the pipe 20, so as to cause waste gasses to flow down the vent pipe and out into the stream 28.

Details of construction and functioning of the holding tank are shown more clearly in FIG. 2. The tank and its principle elements are all made preferably of a material such as stainless steel, which is not affected by the chemicals used to sanitize and to prevent odors, nor by the waste products deposited in the tank. Although any well-known leak-proof fabricating techniques may be used, welding is a preferred method of assembling the tank and its inner parts and vent pipe.

To reduce sloshing of liquid in the tank during vehicle motion, and aid in preventing the escape of odors, the tank is divided into upper and lower tanks by a partition 34 extending parallel to the top surface 12 and a bottom surface 36 of the tank. In accordance with well-known practice in the art, additional vertical baffles not shown may be provided to reduce sloshing and to provide stiffening of the tank walls.

The vent pipe 20 extends vertically upward through the tank, being welded to the bottom 36 so as to prevent leakage of waste liquid, and passing through an opening 38 in the partition 34. Preferably, the opening is larger than the outside diameter of the vent pipe so that air may pass by the pipe, but one or more tabs 40 extend from the partition to the pipe and are welded to the pipe to prevent movement of the pipe because of the vehicle vibration.

As shown clearly in FIG. 2, the upper end 22 of the vent pipe extends through the vent opening 24 in the tank top a sufficient distance so that liquid will overflow the tank top through the opening 15 before it rises high enough to enter the vent pipe 20. However, the vent clears the sides of the opening 24 and the inside of the cap 14 a sufficient distance so that air and noxious gasses can flow readily into the pipe from the interior of the upper tank.

In FIG. 2 the tank is shown filled with liquid up to a normal fill level 42, which is established by the height of a filling gauge pipe 44 open at its upper end 46 inside the tank, and extending downward and passing through the bottom of the tank 36, to which a weld seal is formed. A flexible hose 48 connected to the bottom end of the gauge pipe 44 extends to a drain cock 50 mounted in any convenient location on the vehicle for access by an attendant at the time of servicing the tank.

The removable insert 16 is also made conveniently of stainless steel. Preferably, it consists of vertical walls 52 extending downward from the flange 18, and passing through the opening 15 in the top 12 with a small clearance so that the insert is held against excessive sideways movement, but so that some air can pass under the flange 18 and between walls 52 and the edge of the opening 15, for reasons to be described below. The insert walls extend through and below an opening 54 in the partition, with again sufficient clearance being provided between the insert and the opening so that air may pass downward around the insert. The insert walls 52 are of such length that the bottom opening of the insert is above the level of liquid which is normally reached through addition of waste materials before the end of a normal servicing interval. Ventilating air can therefore pass down through the insert, between the bottom edge of the walls 52 and the surface of the liquid, and then upward through the opening 38 in the partition and the opening 24 in the top of the tank. However, if there is excessive use of the toilet, such that a higher than desired level of liquid is obtained, the lower edge of the insert will be submerged, and will provide additional baffling against liquid slosh even though the air venting area is reduced, and the desired ventilation through the insert is lost.

A water fill pipe coupling 51 is provided in any convenient location in the bottom or lower side surfaces of the tank for connection to any well-known valve and tubing arrangement to provide fresh water for flushing, cleaning and filling the tank.

A short length of drain pipe 62 is also provided at an additional opening in the bottom 36, leading to a slide valve 64 and air cylinder 66 indicated schematically, so that connection may be made by any well-known means to a sewage or septic system for periodically draining waste material from the holding tank.

Normal servicing intervals are dictated by the anticipated use of the vehicle toilet. However, unlike certain of the recirculating unit designs, initially excessive use will cause the liquid level merely to rise above the bottom of the insert. The risk of overflow or of unsanitary, improper operation is minimized by the ready view of the level of the contents by those who may use the toilet. Routine servicing may be limited to connection of the drain valve 64 to a sewage system, emptying the tank of its contents by appropriate application of air pressure to the cylinder 66, addition of sanitizing chemicals after the valve has been closed and admission of water through the fill coupling 51. The attendant does not need to measure the quantity of water being added, however, because of the gauge pipe 44 provided. By opening the drain cock 50, the attendant will know when the filling level 42 has been reached because at this point liquid will run down the pipe 44 and out the drain cock. By merely stopping the waterflow into the tank and shutting the drain cock he is assured that only the proper amount of water has been added to the holding tank.

The accrual of deposits within the tank, which may give rise to unpleasant odors even immediately after the above described routine servicing, is readily prevented by periodically removing the insert 16 so that the interior of the tank may be inspected and may be flushed out or otherwise thoroughly cleaned.

In a preferred embodiment intended for use in a passenger bus, the opening 32 was cut at an angle of 60° with respect to a perpendicular to the pipe. The air stream from the air conditioning condenser system was used because this fan is driven directly by the vehicle engine, and will thus be operating at almost any time that there will be passengers in the bus.

Sanitizing chemicals are available, and known to those of ordinary skill in the art, which form an odor proof barrier at the liquid surface when the liquid is still, so that odors will not be released when the bus is not in use. The ability readily to clean the tank interior thoroughly eliminates odors from accumulation of solids on the walls, and thus enables the full advantage of these chemicals to be realized. As soon as engine vibration or bus motion would cause sufficient movement of the liquid surface to disturb this barrier, the draft of the fan will cause fresh air to be drawn continuously down through the insert, or between the flange 18 and the top 12, so that the holding tank is continuously ventilated.

For use in other types of vehicles, other embodiments in accordance with the basic invention will be clear to those of ordinary skill in the art. For example, the vent pipe might be placed in an air stream external to the vehicle, resulting from motion as in a railway train, or from engine operation, for example resulting from the exhaust of a jet engine. The opening in the air stream may be in an elbow oriented downstream, or any other well-known suction-producing configuration. The removable insert walls may taper or otherwise vary from a cylindrical arrangement.

What is claimed is:

1. A toilet waste holding apparatus for a vehicle comprising:

a tank comprising a top and a bottom, the top having a vent opening therethrough, a horizontal partition dividing the tank into upper and lower tanks, said partition and tank top having aligned openings therethrough, said lower tank being arranged to receive a store of liquid up to a normal liquid level, a removable insert defining a waste receiving passage and extending above the tank top and through said aligned openings into said lower tank above the normal liquid level, said insert fitting loosely into said partition and tank top openings so as to permit air flow around the outside of said insert, and means for positioning the insert with respect to the tank top, means for allowing an overflow of liquid within the tank to flow onto the tank top, a vent pipe connected to the tank so as to pass through the vent opening in the top, said opening being sufficiently large to permit air and gases to flow around the vent pipe, the vent pipe having first and second ends, the first end being disposed above said tank top for carrying away air and gases released from any waste material in the tank and passing through said opening in the top between the top and the pipe, the second end extending below said tank bottom and having an angle cut in the end, means, independent of vehicle motion, for blowing a stream of air past said second end so as to suck air and gases from within said vent pipe, and a vent pipe cap mounted over said first end and connected to the tank top around the vent opening such that suction in the vent pipe will pull air and gases flowing through the top opening around the pipe into the pipe while allowing any overflow of liquid to run across the tank top without entering the vent pipe.

2. An apparatus as claimed in claim 1, wherein said cut is at an angle of approximately 60° with respect to the air flow.

3. A toilet waste holding apparatus for a vehicle comprising:

a tank arranged such that waste products fall directly into the tank, the tank comprising a horizontal partition dividing the tank into upper and lower tanks, said upper tank having a top, said partition and tank top having aligned openings therethrough, said lower tank being arranged to receive a store of liquid up to a normal liquid level;

a removable insert defining a waste receiving passage and extending above the tank top and through said openings into said lower tank above the normal liquid level, said insert fitting loosely into said partition and tank top openings so as to permit continuous air flow around the outside of said insert; and means for positioning the insert with respect to the tank top;

a vent pipe having first and second ends, the first end connected to the tank for carrying away gases released from any waste material in the tank, wherein said lower tank comprises a bottom, and said upper tank top has a vent opening therethrough, said vent pipe being connected to the tank so as to pass through the bottom and the vent opening in the top, said vent opening being sufficiently large to permit air and gases to flow around the vent pipe, the second end below said tank adapted to be disposed in a moving stream of air such that suction is developed by the movement of air, whereby gases in the vent and tank are sucked out at said second end;

and said tank further comprises means for allowing any overflow of waste liquid to flow along the outside of said insert onto the tank top, and means for preventing any overflow of waste liquid from entering said vent pipe, said preventing means comprising a portion of said vent pipe adjacent said first end and extending above the tank top, and a vent pipe cap mounted over said first end and connected to the tank top around the vent opening so that gases flowing from the tank through the opening around the vent pipe may be drawn into the vent pipe by suction therein, while liquid rising to a level of said opening around said vent pipe is not drawn into the vent pipe.

4. An apparatus as claimed in claim 3 comprising in addition gauge means in the bottom tank for sensing the level of liquid.

5. An apparatus as claimed in claim 3 wherein said second end has an oblique cut at an angle of approximately 60° from a plane perpendicular to the pipe.

* * * * *